US010345085B2

(12) United States Patent
Fricke

(10) Patent No.: US 10,345,085 B2
(45) Date of Patent: Jul. 9, 2019

(54) PROJECTILE HAVING LEADING SURFACE STANDOFFS

(71) Applicants: Lehigh Defense, LLC, Quakertown, PA (US); Black Hills Ammunition Inc., Rapid City, SD (US)

(72) Inventor: David B. Fricke, Quakertown, PA (US)

(73) Assignees: Lehigh Defense, LLC, Quakertown, PA (US); Black Hills Ammunition Inc., Rapid City, SD (US)

( * ) Notice: Subject to any disclaimer, the term of this patent is extended or adjusted under 35 U.S.C. 154(b) by 6 days.

(21) Appl. No.: 15/713,988

(22) Filed: Sep. 25, 2017

(65) Prior Publication Data

US 2018/0209770 A1 Jul. 26, 2018

Related U.S. Application Data

(60) Provisional application No. 62/448,731, filed on Jan. 20, 2017.

(51) Int. Cl.

| | |
|---|---|
| ***F42B 12/02*** | (2006.01) |
| ***F42B 5/02*** | (2006.01) |
| ***F42B 10/22*** | (2006.01) |
| ***F42B 30/02*** | (2006.01) |

(52) U.S. Cl.

CPC ..... *F42B 12/02* (2013.01); *F42B 5/02* (2013.01); *F42B 10/22* (2013.01); *F42B 30/02* (2013.01)

(58) Field of Classification Search

CPC .. F42B 5/02; F42B 10/22; F42B 10/24; F42B 10/52; F42B 12/02; F42B 12/04; F42B 12/08; F42B 12/105; F42B 30/00; F42B 30/02; F42B 99/00

USPC ..... 102/436, 439, 508–510

See application file for complete search history.

(56) References Cited

U.S. PATENT DOCUMENTS

| | | | | | |
|---|---|---|---|---|---|
| 1,373,322 | A * | 3/1921 | Freitas | F42B 10/22 | 244/3.23 |
| 3,002,453 | A * | 10/1961 | Fedor | F42B 10/46 | 102/382 |
| 3,003,418 | A * | 10/1961 | Young | F42B 12/40 | 101/368 |
| 3,848,532 | A * | 11/1974 | Abbott | F42B 5/02 | 102/364 |
| 4,550,662 | A * | 11/1985 | Burczynski | F42B 12/34 | 102/509 |
| 4,665,827 | A * | 5/1987 | Ellis, II | F42B 12/34 | 102/510 |
| 5,116,224 | A * | 5/1992 | Kelsey, Jr. | F42B 10/22 | 102/439 |

(Continued)

OTHER PUBLICATIONS

PolyCase Ammunition, ARX Projectile, Inceptor Preferred Hunting (Jan. 2017).

(Continued)

*Primary Examiner* — Stephen Johnson
*Assistant Examiner* — Benjamin S Gomberg
(74) *Attorney, Agent, or Firm* — Fox Rothschild LLP

(57) ABSTRACT

A projectile has a base, a tip, and a body axis intersecting the base at a trailing axis point and the tip at a leading axis point. The projectile includes a meplat that is substantially orthogonal to the body axis and a plurality of standoffs that extend away from both the trailing axis point and the leading axis point.

12 Claims, 13 Drawing Sheets

(56) References Cited

U.S. PATENT DOCUMENTS

| | | | | |
|---|---|---|---|---|
| 5,528,990 | A * | 6/1996 | Corzine | F42B 12/34 102/509 |
| 6,453,820 | B1 * | 9/2002 | Anderson | F42B 10/24 102/439 |
| 7,934,455 | B2 * | 5/2011 | Winter | F42B 10/22 102/517 |
| 9,194,676 | B1 * | 11/2015 | Masinelli | F42B 5/025 |
| 9,383,178 | B2 * | 7/2016 | Powers, Jr. | F42B 12/34 |
| 2016/0025469 | A1 * | 1/2016 | Nurminen | F42B 12/34 102/508 |
| 2016/0231093 | A1 | 8/2016 | Lemke et al. | |

OTHER PUBLICATIONS

PolyCase Ammunition, ARX Projectile, Inceptor Preferred Defense (Jan. 2017).
Ruger ARX Ammunition, Tech Sheet (Jan. 2017).

* cited by examiner

PROJECTILE HAVING LEADING SURFACE STANDOFFS

CROSS-REFERENCE TO RELATED APPLICATIONS

This application claims priority to U.S. Provisional Patent Application 62/448,731 filed Jan. 20, 2017, the disclosure of which is incorporated herein by reference in its entirety.

INTRODUCTION

Projectiles in tubular or "tube fed" magazines are axially aligned such that the meplat of a first projectile faces the rear casing of a second projectile. In this type of magazine configuration, the meplat of the first projectile contacts the primer of the second projectile, which can be dangerous because sufficient force applied by the meplat of the first projectile may activate the primer of the second projectile, and accidentally discharge the second projectile while inside the tube fed magazine.

SUMMARY

The present disclosure relates generally to a projectile having standoffs that prevent accidental discharge inside tube fed magazines of axially aligned projectiles.

In one aspect, the disclosed technology relates to a projectile including a base, a tip, a body axis intersecting the base at a trailing axis point and the tip at a leading axis point, a meplat substantially orthogonal to the body axis, and a plurality of standoffs extending away from both the trailing axis point and the leading axis point. In one embodiment, each of the plurality of standoffs extends from the leading axis point to the meplat. In another embodiment, the meplat includes a plurality of discrete surfaces separated by the plurality of standoffs. In another embodiment, the plurality of discrete surfaces prevents the leading axis point from touching a primer of an adjacent projectile. In another embodiment, the projectile further includes a plurality of fins each terminating at the plurality of discrete surfaces. In another embodiment, the plurality of fins each includes a sloping surface extending from the leading axis point to a discrete surface of the meplat. In another embodiment, of the plurality of standoffs extends from the meplat. In another embodiment, the plurality of standoffs prevents the leading axis point from touching a primer of an adjacent projectile. In another embodiment, the leading axis point is defined on the meplat. In another embodiment, the meplat is a continuous surface shaped by an intersection of a plurality of fins. In another embodiment, each standoff is an extension of a fin. In one aspect, the disclosed technology relates to a cartridge that includes the projectile.

In another aspect, the disclosed technology relates to a cartridge of ammunition for a firearm, including a casing having a first end, a primer substantially disposed on the first end, wherein the primer defines a primer diameter, and a projectile at least partially disposed in the casing, wherein the projectile includes a meplat substantially orthogonal to a body axis of the projectile, and a plurality of standoffs defining a standoff diameter, wherein the standoff diameter is greater than the primer diameter. In one embodiment, the projectile further includes a base, a tip, and a body axis intersecting the base at a trailing axis point and the tip at a leading axis point, wherein the plurality of standoffs substantially surround the body axis and extend away from both the trailing axis point and the leading axis point. In another embodiment, each of the plurality of standoffs extends from the leading axis point to the meplat. In another embodiment, the meplat includes a plurality of discrete surfaces separated by the plurality of standoffs. In another embodiment, the plurality of discrete surfaces prevents the leading axis point from touching a primer of an adjacent cartridge. In another embodiment, the cartridge further includes a plurality of fins each terminating at the meplat and defining each of the plurality of discrete surfaces. In another embodiment, the plurality of fins each comprises a sloping surface extending from the leading axis point to a discrete surface of the meplat.

A variety of additional aspects will be set forth in the description that follows. The aspects can relate to individual features and to combination of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
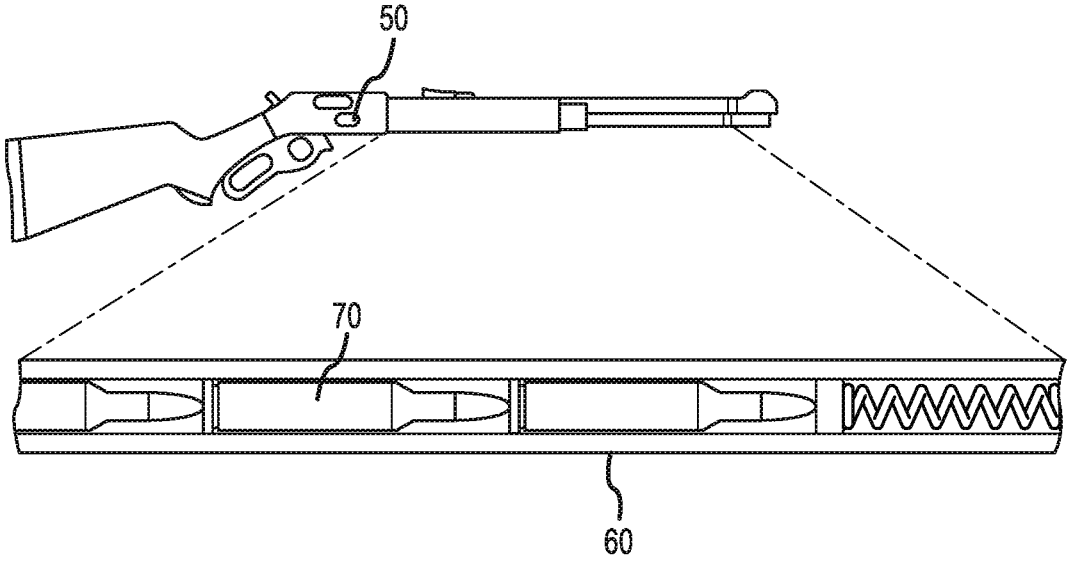
PRIOR ART FIG.1
FIG. 1 is a side view of an example firearm with a tube fed magazine.

FIG. 1 shows an example firearm 50 and an enlarged partial cross-section view of a tube fed magazine 60 arranged within the firearm 50. As shown in FIG. 1, the tube fed magazine 60 comprises a series of axially aligned cartridges 70. Tube fed magazines can be used in lever-action rifles which are popular for hunting due to their short length and high rate of fire. Cartridges comprising projectiles having pointed tips or a small meplat can cause explosions in the tube fed magazine 60, as the tip or meplat of each cartridge's projectile rests on the primer of the next cartridge in the tube fed magazine.

In accordance with the present disclosure, the shape of a projectile creates a buffer between the point or tip of a projectile and the primer of an axially adjacent cartridge. In general terms, a projectile is described as having a body and a central body axis A that intersects the body at a trailing axis point B (i.e., the base of the projectile) and at a leading axis point C (i.e., the point or tip of the projectile). As described herein, the buffer is made of a plurality of standoffs which can be defined as a plurality of elements substantially surrounding the body axis A of the projectile, and extending away from both the trailing axis point B and the leading axis point C such that the standoffs create a buffer between the leading axis point C of the projectile and a primer of an axially adjacent cartridge. The projectile includes a meplat, and the leading axis point C may be on the meplat or the meplat may be comprised of the plurality of standoffs. The following embodiments are exemplary and explanatory, and accordingly, are not restrictive of the broad inventive concept upon which these embodiments are based.

Figure 2:
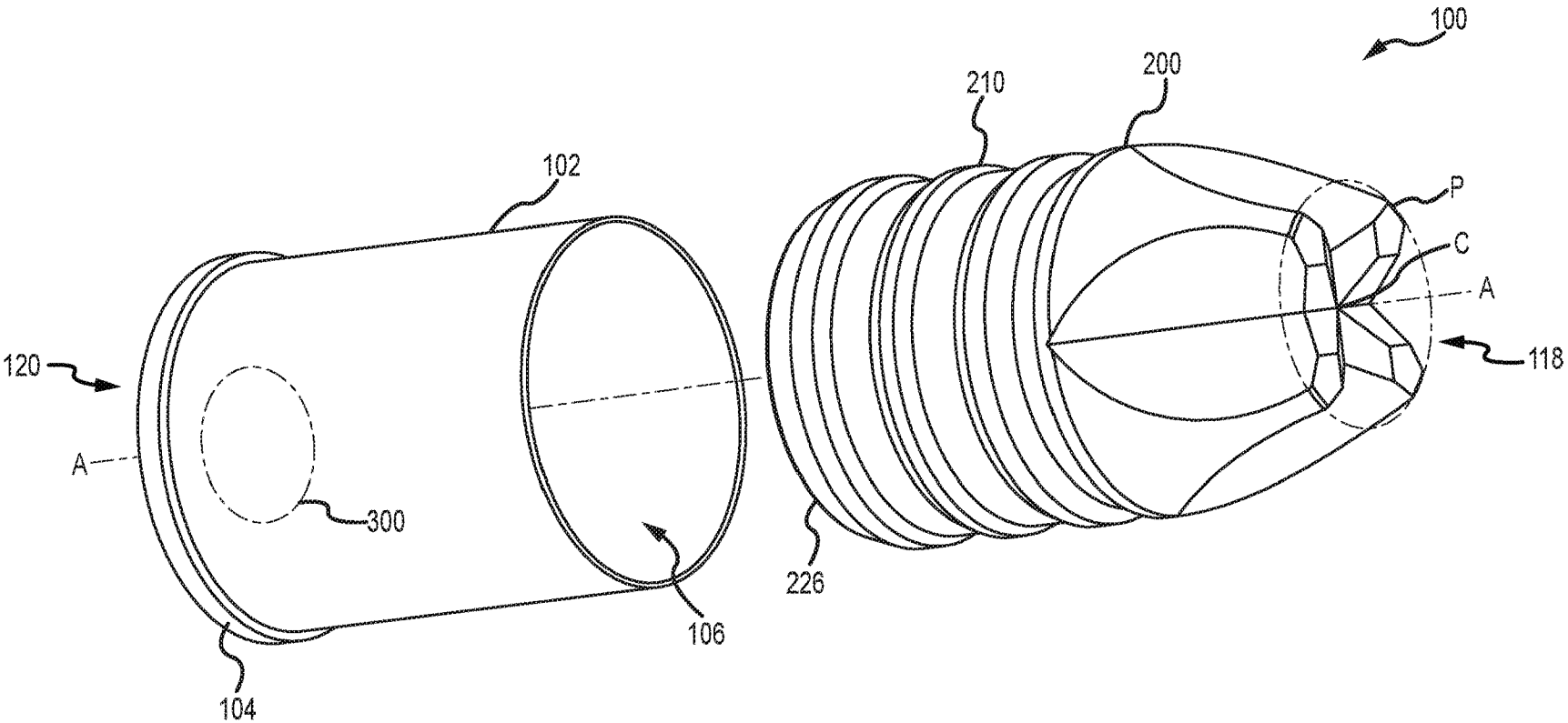
FIG. 2 is an exploded front perspective view of a first embodiment of a cartridge comprising a casing and a projectile.

FIG. 2 is an exploded perspective view of a cartridge 100 having an annular casing 102 and a first embodiment of a projectile 200. Generally, the cartridge 100 includes a front 118 in the direction of the projectile 200 and a rear 120 in the direction of the annular casing 102. Throughout this disclosure, references to orientation (e.g., front(ward), rear (ward) etc.) shall be defined by the position of a component relative to the front 118 and/or rear 120 of the cartridge 100 regardless of how the cartridge 100 may be held and regardless of how that component may be situated on its own (e.g., separated from the cartridge 100).

The projectile 200 includes a body 210 and a central body axis A that intersects the body 210 at a leading axis point C. The body 210 includes a bottom 226 disposed toward the rear 120 and a meplat plane P substantially orthogonal to the body axis A.

The casing 102 includes an open end 106 into which the bottom 226 of the projectile 200 is inserted during assembly of the cartridge 100. When the cartridge 100 is assembled, the interior of the casing 102 is filled with a propellant (e.g., gunpowder) that is ignited by the primer 300 (shown in broken lines) disposed at a rear end 104 of the casing 102.

Figure 3:
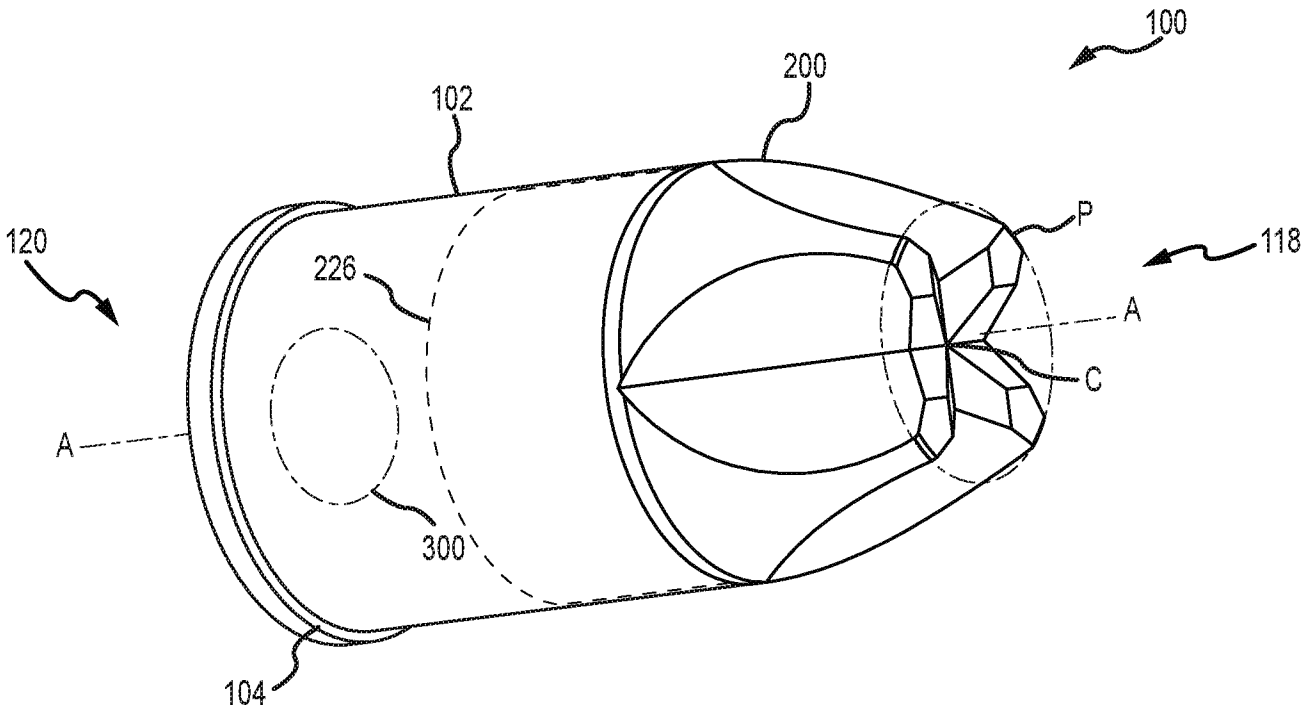
FIG. 3 is a front perspective view of the assembled cartridge of FIG. 2.

FIG. 3 is an assembled perspective view of the cartridge 100. When assembled, the projectile 200 is at least partially encased by the casing 102 such that the bottom 226 (shown in broken lines) is surrounded by the casing 102. The primer 300 is disposed at the rear end 104 of the casing 102. When the primer 300 is struck by a trigger mechanism of a firearm, the primer 300 ignites the propellant inside the casing 102 causing the propellant to explode. This forces the projectile 200 from the cartridge 100 and discharges the projectile 200 out of the barrel of the firearm. In automatic and semi-automatic firearms, the force of the explosion from the propellant is sufficient to cycle the firearm, i.e., discharge the projectile 200, eject the spent casing 102, and load a new cartridge 100 into the firing chamber of the firearm. The projectile 200, when utilized in a cartridge 100 having an appropriate casing 102 and primer 300, can be fed from a magazine of virtually any capacity, in automatic, semi-automatic, lever-action, and bolt-action firearms. The projectile 200, casing 102, primer 300, and propellant may be partially assembled using one or more pieces of automated equipment. Alternatively, the projectile 200, casing 102, primer 300, and propellant may be partially assembled by hand.

Figure 4:
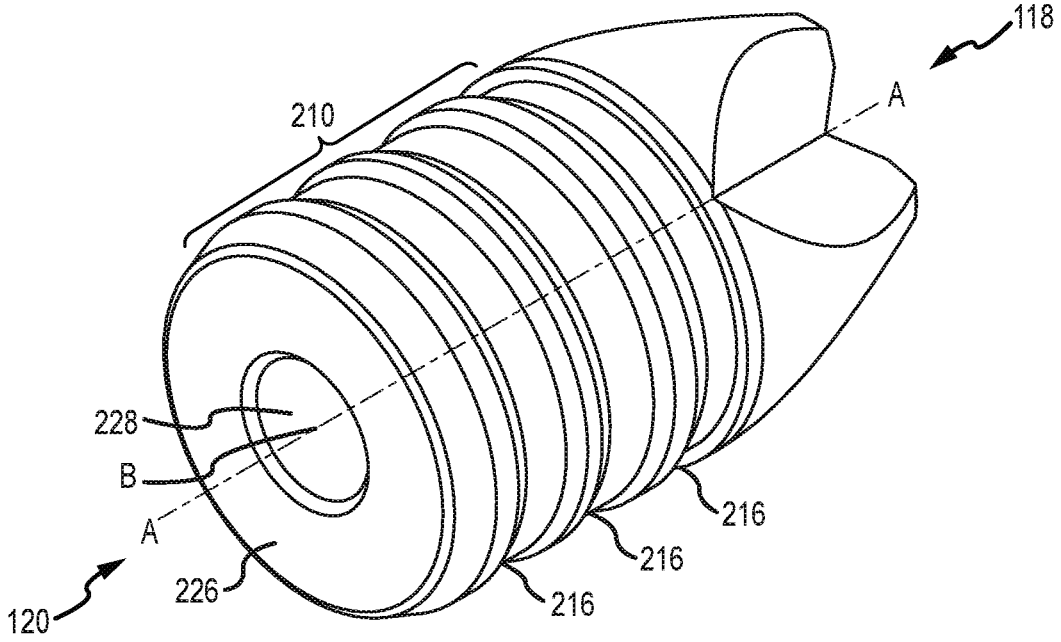
FIG. 4 is a rear perspective view of the projectile of FIG. 2.
Figure 5:
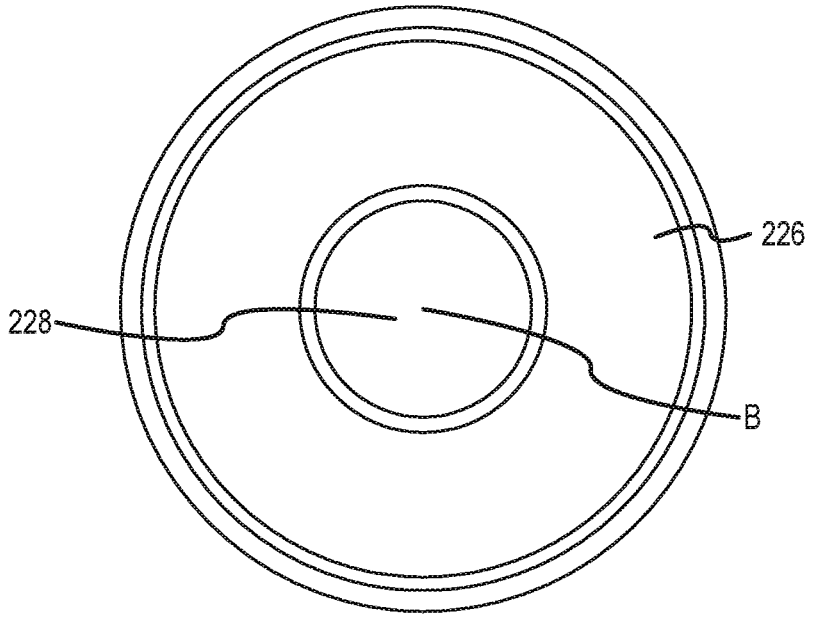
FIG. 5 is a rear view of the projectile of FIG. 2.

FIG. 4 is a rear perspective view of the first embodiment of the projectile 200, and FIG. 5 is a rear view thereof. These figures show a trailing axis point B on the bottom 226 of the projectile 200 which is where the central body axis A intersects the body 210.

Figure 6:
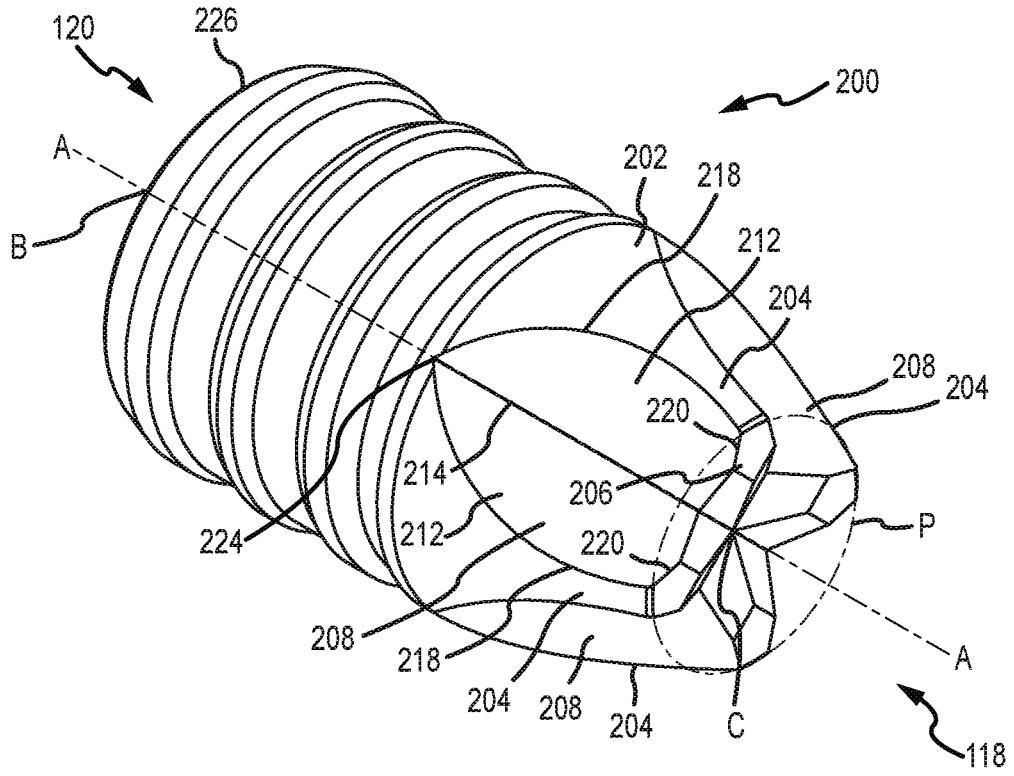
FIG. 6 is a front perspective view of the projectile of FIG. 2.

FIG. 6 is a front perspective view of the first embodiment of the projectile 200. The projectile 200 includes an ogive (e.g., curved outer surface) 202 having a plurality of fins 204 that form a meplat 206 towards the front 118 of the projectile 200. The meplat 206 is a leading surface of the projectile 200 that defines the meplat plane P which is substantially orthogonal to the body axis A of the projectile 200. In the figures, the projectile 200 is depicted as having four fins 204 that are spaced from each other by a corresponding number of longitudinal flutes 208. Other numbers of fins and flutes are possible. For example, projectiles having fewer than four flutes and four corresponding fins (such as three flutes and fins and even as few as two flutes and fins) are contemplated. Projectiles having a greater number of flutes and fins are also contemplated.

The flutes 208 are each defined by two curved surfaces 212 that also form surfaces of the fins 204. Each curved surface 212 may be substantially constant in radius of curvature from the meplat 206 towards a termination point 224. In another embodiment, the curved surfaces 212 may start a distance away from the meplat 206, thus defining a meplat portion that has walls substantially parallel to the body axis A of the projectile 200, prior to beginning the curved surface 212. The curved surfaces 212 intersect at an inner intersection curve 214 that is radially equidistant from adjacent fins 204 such that the flutes 208 are symmetrical. In some examples, the curved surfaces 212 are curved from fin edges 220 which begin at the meplat 206 to the flute termination point 224, and the curved surfaces 212 are curved from an outer intersection curve 218 to the inner intersection curve 214 such that the curve surfaces 212 are concave.

The flutes 208 of the projectile 200 generate a powerful hydraulic force when the projectile 200 hits a "wet target." Wet targets include, for example, animals and persons, as well as water such as in discharge testing tanks, and gel ordnance test blocks. As the projectile 200 moves forward within a wet target, fluid (water, blood, etc.) that enters the flutes 208 travels along and within the flutes 208 from the meplat 206 towards the flute termination point 224. More specifically, as the projectile 200 moves forward in the wet target, fluid that is within the path of travel of the projectile 200 is thrown outward due to hydraulic pressure as that fluid reaches the portions of the curved surfaces 212 proximate the termination point 224. Thus, fluid that enters the flutes 208 is ejected therefrom by a strong hydraulic force. As such, the fluid is projected substantially radially outward from the axis A of the projectile 200, creating a larger wound cavity and resulting in a cleaner kill when used against a wet target.

Figure 7:
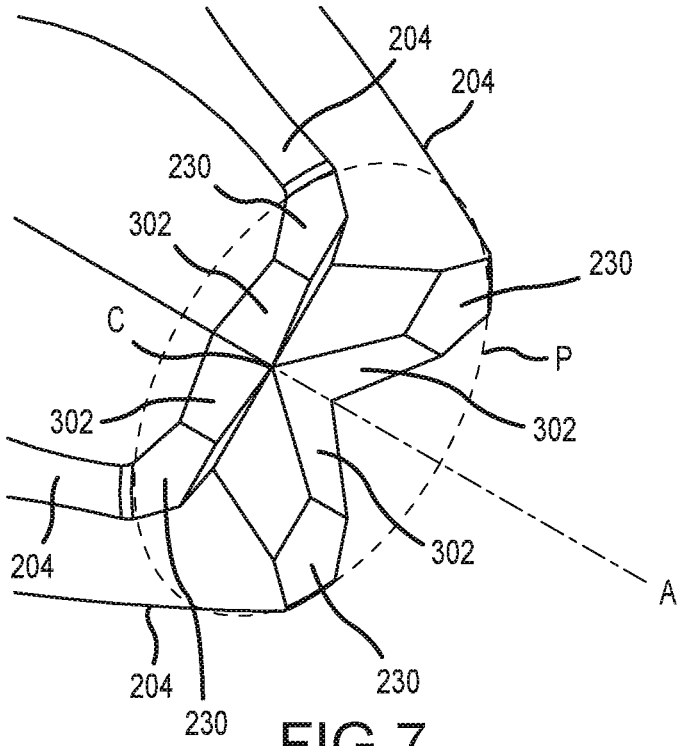
FIG. 7 is a close up view of the tip of the projectile of FIG. 2.

FIG. 7 is a close up view of the tip of the first embodiment of the projectile 200. Standoffs 302 originate at the leading axis point C and extend to a surface 230 of the meplat 206. The standoffs 302 create a cavity or empty space between each fin 204 at the meplat 206 such that the surface of the meplat 206 is interrupted. In this case, the meplat 206 is not a continuous surface between the fins 204 of the projectile 200, but instead comprises a plurality of discrete surfaces 230. The standoffs 302 substantially surround the body axis A of the projectile 200, and extend away from both the trailing axis point B and the leading axis point C such that the standoffs create a buffer between the leading axis point C of the projectile 200 and a primer 300 of an axially adjacent cartridge. In this sense, the meplat 206 acts as the buffer between the point (e.g., the leading axis point C) of the projectile 200 and the primer of an axially adjacent cartridge. The projectile 200 is depicted in the figures as having four standoffs 302 (i.e., one standoff 302 for each fin 204). However, the number of standoffs 302 can vary depending on the number of fins 204 disposed in the ogive 202 of the projectile 200. As described above, the projectile 200 is not limited to an embodiment having four fins 204 and four corresponding flutes 208, but rather the number of fins 204 and corresponding flutes 208 may vary as required or desired for a particular application. Also, in the example depicted in the figures, the surface 230 is a flat surface such that the projectile 200 has a flat nose; however, in other embodiments, surface 230 is not a flat surface. For example, the surface 230 could be rounded such that the projectile 200 has a round nose.

Figure 8:
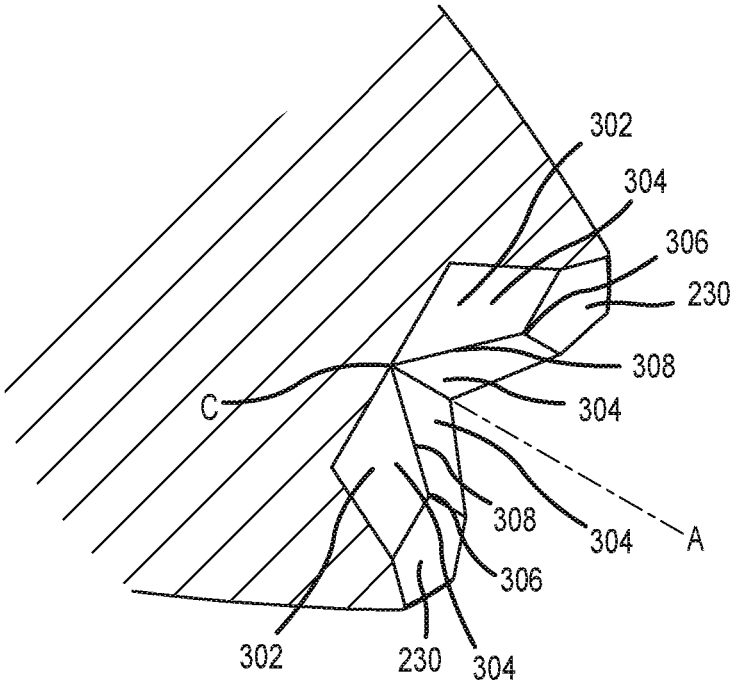
FIG. 8 is a sectional view of the tip of the projectile of FIG. 2.

FIG. 8 is a sectional view of the tip of the projectile 200 shown in FIG. 7. Each standoff 302 comprises an inclined edge 308 that travels from the leading axis point C to the intersection point 306 on each surface 230, and angled surfaces 304 disposed on each side of the inclined edge 308. The inclined edges 308 help to define a standoff diameter Ds that is larger than a primer diameter Dp of the cartridge 100 as will be explained further below. In the example depicted in the figures, the angled surfaces 304 are flat surfaces; however, in other embodiments, the angled surfaces 304 are not flat surfaces.

Figure 9:
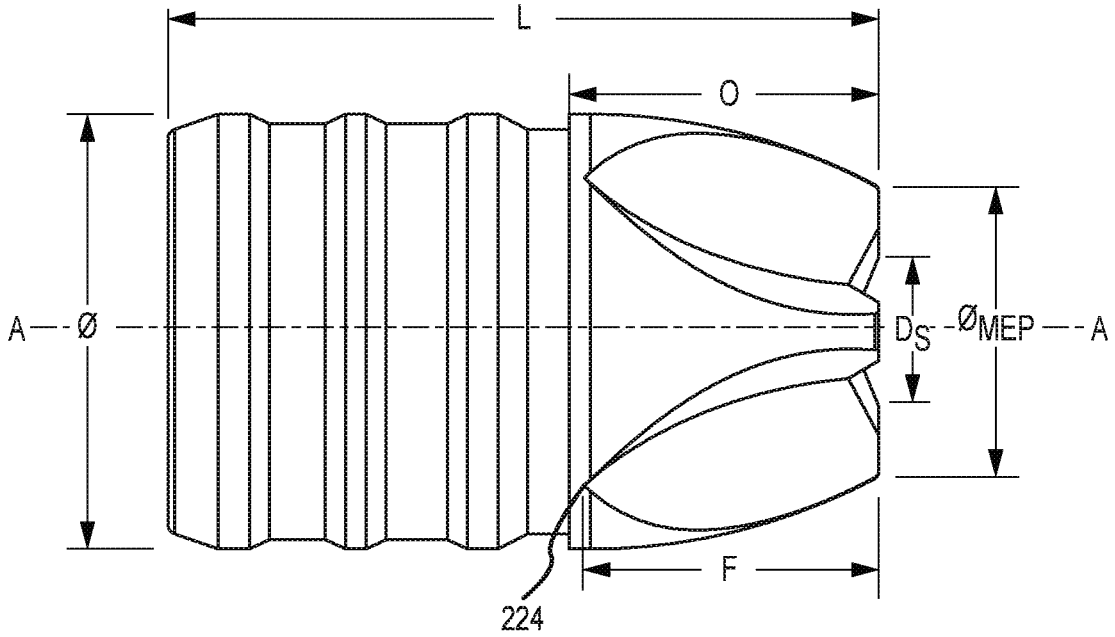
FIG. 9 is a side view of the projectile of FIG. 2.

FIG. 9 is a side view showing some exemplary dimensions of the first embodiment of the projectile 200. The projectile 200 has a length L and a caliber Ø (e.g., a maximum diameter). The ogive 202 has an ogive length O as measured along the body axis A. Each flute 208 has a flute length F as measured along the body axis A from the termination point 224 to the meplat plane P. The meplat 206 has a meplat diameter $Ø_{MEP}$, and the standoffs 302 have a standoff diameter Ds. The standoff diameter Ds is defined as a distance between opposing intersection points 306.

Figure 10:
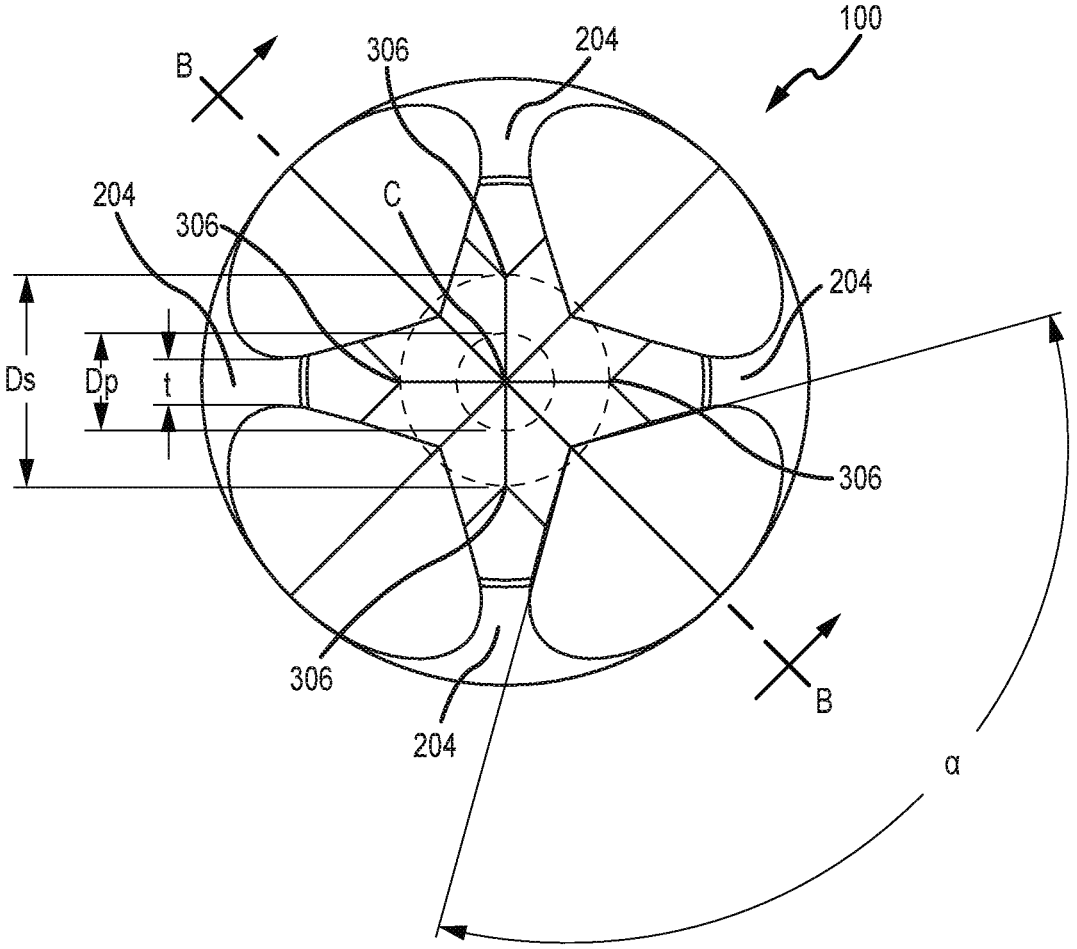
FIG. 10 is a meplat end view of the cartridge of FIG. 2.

FIG. 10 is a meplat end view of the cartridge 100 of FIG. 2. When the cartridge 100 is assembled, a spatial relationship exists between the standoffs 302 of the projectile 200 and the primer 300 of the casing 102. As described above, the standoffs 302 have a standoff diameter Ds defined as a distance between opposing intersection points 306. In other words, the standoff diameter Ds is defined by a circumference of an imaginary circle that connects each of the intersection points 306. A primer diameter Dp is defined by the perimeter of the primer 300 disposed on the rear end 104 of the casing 102. As shown in FIG. 10, the standoff diameter Ds is larger than the primer diameter Dp. This spatial relationship in the cartridge 100 prevents the meplat 206 of a first cartridge from contacting the primer 300 of a second cartridge when the first and second cartridges are axially aligned such as, for example, when contained in a tube fed magazine. This reduces or eliminates the risk of an accidental ignition of the second cartridge by the first cartridge in a tube fed magazine configuration. Accordingly, the spatial relationship between the standoff diameter Ds and the primer diameter Dp enhances the safety of the projectile 200 when assembled in the cartridge 100.

FIG. 10 also shows each fin 204 having a minimum thickness t at the meplat 206. The minimum thickness t helps the projectile 200 more easily penetrate a barrier after being discharged from a firearm. Also shown in FIG. 10 is an angle α which separates each fin 204 on the meplat plane P. The angle α can vary as required or desired for a particular application, and the number of fins 204 disposed in the ogive 202 of the projectile 200 may limit the size of the angle α.

Figure 11:
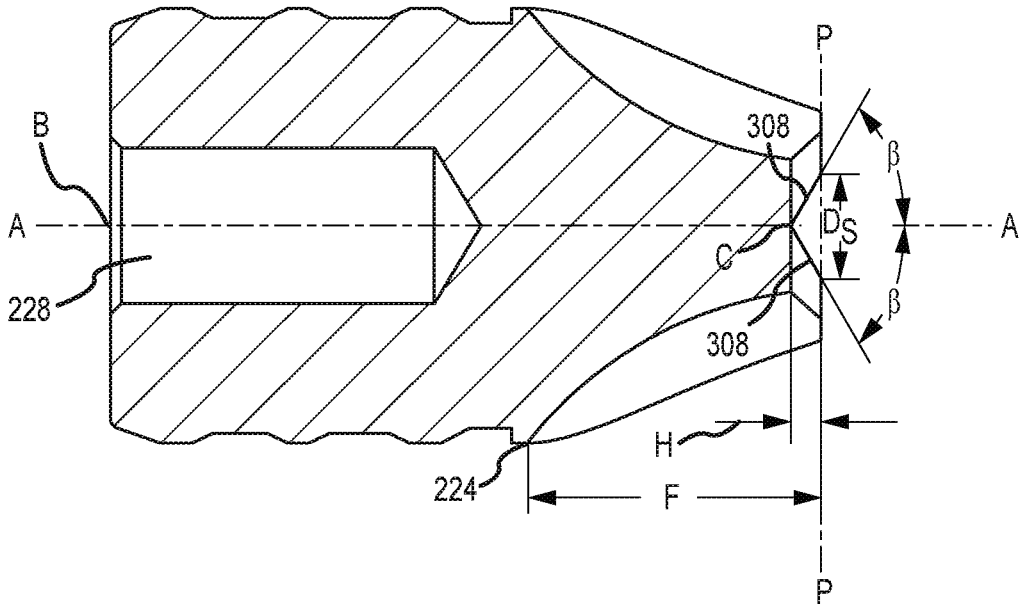
FIG. 11 is a sectional side view along the line B-B of FIG. 10.

FIG. 11 is a sectional view of the projectile 200 along Section B-B of FIG. 10. Each standoff 302 has a height H measured from the leading axis point C to the meplat plane P. Also, the inclined edge 308 of each notched standoff 302 forms an angle β with respect to the body axis A of the projectile 200. Also shown in FIG. 11 is a cross-section of the bore 228.

FIGS. 12-17 describe a second embodiment of a projectile 400. For the sake of brevity, a description of the elements shared between the first and second embodiments of the projectile is omitted; however, the description of elements in FIGS. 1-11 applies to the elements in FIGS. 12-17 that have the same numerical identifiers.

Figure 12:
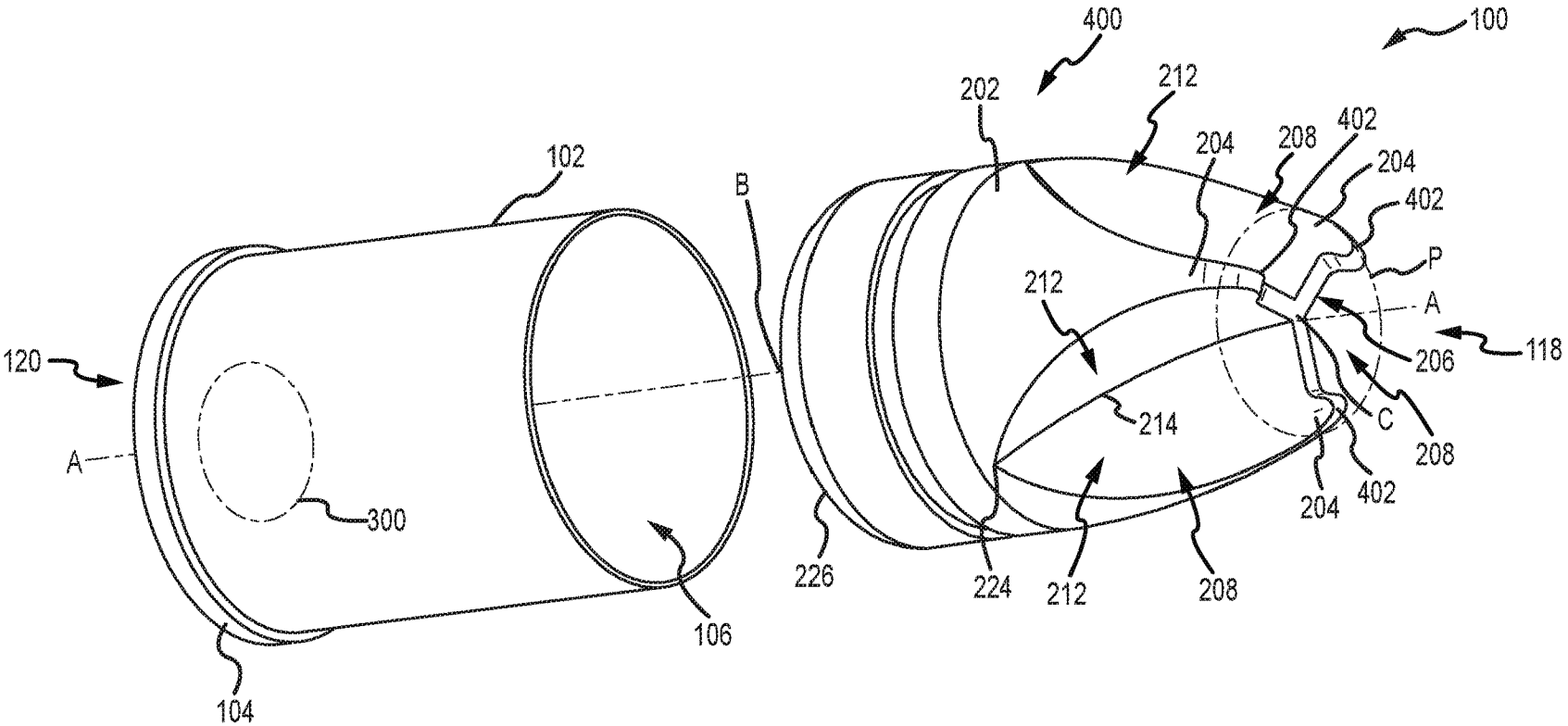
FIG. 12 is an exploded front perspective view of a second embodiment of a cartridge comprising a casing and a projectile.
Figure 13:
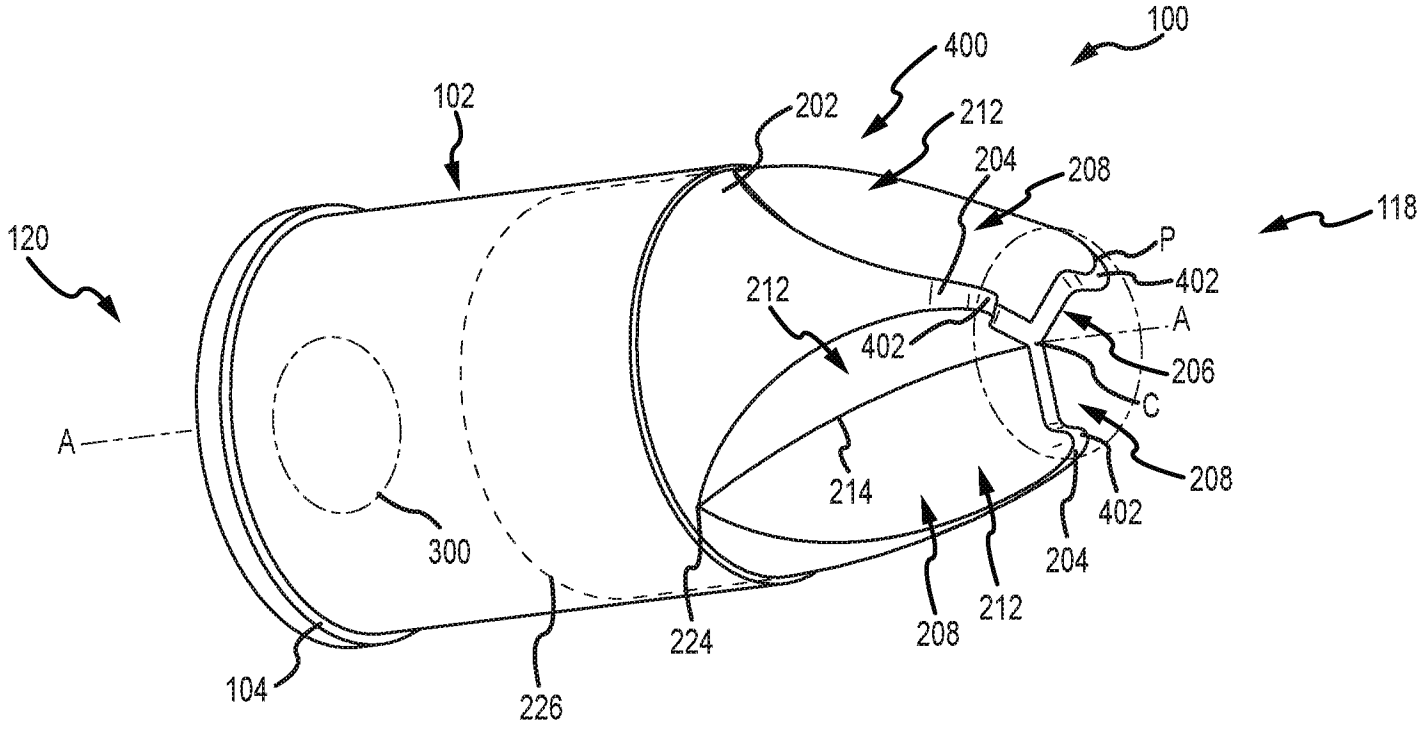
FIG. 13 is a front perspective view of the assembled cartridge of FIG. 12.

FIG. 12 is an exploded perspective view of an example cartridge 100 having an annular casing 102 and the second embodiment of the projectile 400. FIG. 13 is a perspective view of the cartridge 100 assembled with the second embodiment of the projectile 400. The projectile 400 is depicted as having three fins 204 that are spaced from each other by a corresponding number of longitudinal flutes 208. As described above with regard to the first embodiment of the projectile 200, different numbers of fins and flutes are possible such that the projectile 400 could have more or less than three flutes and corresponding fins.

The projectile 400 comprises several standoffs 402 that extend from each fin 204, and that extend beyond the meplat plane P in a direction towards the front 118 of the projectile 400. Like in the first embodiment, standoffs 402 substantially surround the body axis A of the projectile 400, and extend away from both the trailing axis point B and the leading axis point C such that the standoffs 402 create a buffer between the leading axis point C (i.e., the point or tip of the projectile 400) and a primer 300 of an axially adjacent cartridge 100. Unlike the first embodiment, the meplat 206 is a continuous surface between the fins 204 of the projectile 400 and the leading axis point C is disposed on the meplat 206. In the second embodiment, the standoffs 402 act as the buffer between the leading axis point C of the projectile 400 and the primer of an axially adjacent cartridge.

In the examples shown in FIGS. 12-17, the tip of each standoff 402 is rounded and each standoff 402 forms a continuous part of each fin 204 of the projectile 400. In other examples, the tips of the standoffs 402 are not rounded and the standoffs 402 are not continuous with each fin 204. Also, the projectile 400 is depicted in FIGS. 12-17 as having three standoffs 402 (i.e., one standoff 402 for each fin 204). However, the number of standoffs 402 may vary depending on the number of fins 204 disposed in the projectile 400, and as described above, the projectile 400 is not limited to an embodiment having three fins 204 and three corresponding flutes 208.

Figure 14:
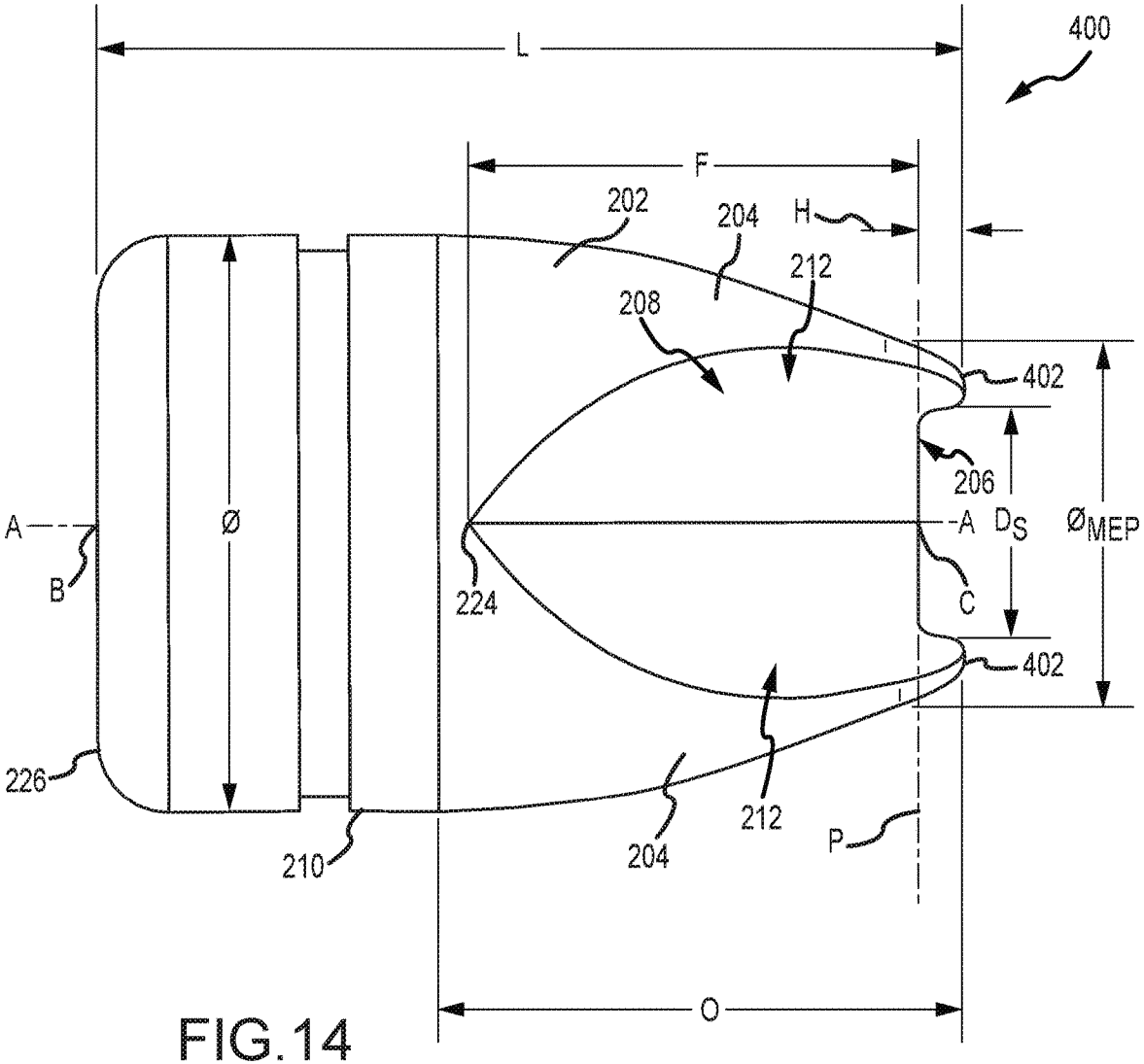
FIG. 14 is a side view of the projectile of FIG. 12.

FIG. 14 is a side view showing some exemplary dimensions of the second embodiment of the projectile 400. The projectile 400 has a caliber Ø, and a length L as measured along the body axis A from the bottom 226 to the tip of each standoff 402. The ogive 202 has an ogive length O as measured along the body axis A. Each flute 208 has a flute length F as measured along the body axis A from the termination point 224 to the meplat plane P. The meplat 206 has a meplat diameter $Ø_{MEP}$, and the standoffs 402 have a standoff diameter Ds. The standoff diameter Ds is defined as a distance between the inside edges of opposing standoffs 402. Each standoff 402 has a height H defined as a distance between the meplat plane P and the tip of each standoff 402.

Figure 15:
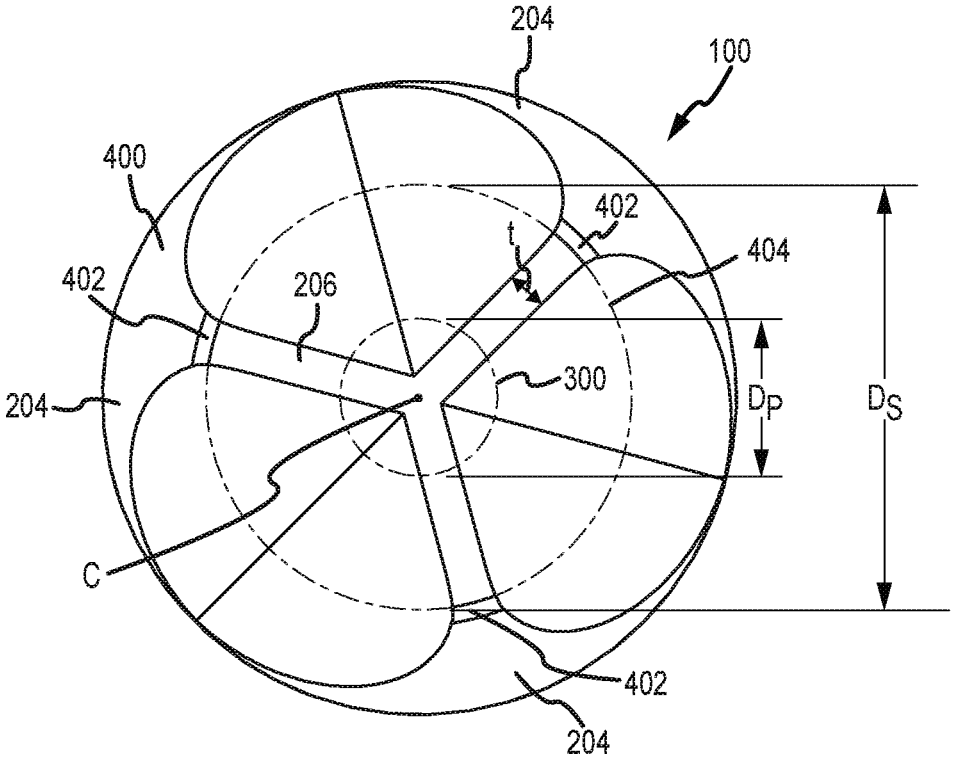
FIG. 15 is a meplat end view of the cartridge 100 of FIG. 12.

FIG. 15 depicts a meplat end view of the cartridge 100 when assembled with the projectile 400. Like in the first embodiment, a spatial relationship between the standoffs 402 and the primer 300 of the cartridge 100 exists. The standoffs 402 define a standoff diameter Ds defined by a circumference of an imaginary circle 404 that connects the inside edge of each standoff 402, whereas the primer 300 forms a primer diameter Dp on the rear end 104 of the casing 102. As depicted in FIG. 15, the standoff diameter Ds is larger than the primer diameter Dp. The height H of each standoff 402 prevents the leading axis point C of a projectile 400 in a first cartridge 100 from contacting the primer 300 of a second cartridge 100 when the first and second cartridges are axially aligned such as, for example, when inserted in a tubular magazine. This substantially reduces or eliminates the risk of an accidental ignition of the second cartridge 100 by the first cartridge 100 in the case of two axially aligned cartridges loaded in a tubular magazine of a firearm.

FIG. 15 further depicts, like in the first embodiment, the fins 204 having a minimum thickness t at the meplat 206 for helping the projectile 400 to more easily penetrate a barrier after being fired from a firearm. A chisel (not shown) may be disposed on the fins 204 for further reducing the minimum thickness t of the fins 204, and hence reducing the thickness of the meplat 206 for further improving barrier penetration.

Some example ratios are particularly beneficial to ensure that a leading axis point C of a first cartridge 100 does not contact the primer 300 of a second cartridge 100 in the case of two axially aligned cartridges 100 loaded in a magazine. For example, the standoff diameter Ds may be between about 20% to about 50% larger than the primer diameter Dp. In one specific example, the standoff diameter Ds may be at least 10% larger than the primer diameter Dp. In one example, the height H that each standoff 302, 402 extends from the leading axis point C may be between about 8% to about 30% the ogive length O.

The projectiles 200, 400 may be manufactured by processes typically used in the manufacture of other projectiles. For example, the projectiles 200, 400 may be cast from molten material, or formed from powdered metal alloys. Projections in the mold may be used to form the flutes 208 or the flutes 208 may be cut into the projectiles 200, 400 after casting. The projectiles 200, 400 may be made from solid copper or brass. Other acceptable materials include copper, copper alloy, copper-jacketed lead, copper-jacketed zinc, copper-jacketed tin, powdered copper, powdered brass, powdered tungsten matrix, steel, stainless steel, aluminum, tungsten carbide, and like materials.

The standoffs 302, 402 can be utilized with any type of projectile and/or casing used in conjunction therewith, whether intended for a tube fed magazine or other magazine. For example, standoffs 302, 402 may be included on the fluted projectiles depicted herein, as well as included on other types of bullets. The standoffs 302, 402 can be machined into a manufactured bullet or formed during the bullet casting process. While the standoffs 302, 402 are not limited to a particular style of rifle or weapon, the standoffs 302, 402 are particularly advantageous to lever-action rifles which use tube fed magazines containing axially aligned bullet cartridges.

It is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting. It must be noted that, as used in this specification, the singular forms "a," "an," and "the" include plural referents unless the context clearly dictates otherwise.

It will be clear that the products and methods described herein are well adapted to attain the ends and advantages mentioned as well as those inherent therein. Those skilled in the art will recognize that the products and methods within this specification may be implemented in many manners and as such is not to be limited by the foregoing exemplified embodiments and examples. In this regard, any number of the features of the different embodiments described herein may be combined into one single embodiment and alternate embodiments having fewer than or more than all of the features herein described are possible.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. A projectile comprising:

a body comprising a base and a tip forward of the base;

a body axis intersecting the base at a trailing axis point and the tip at a leading axis point;

wherein the body comprises a plurality of fins, the fins defining a meplat and a plurality of flutes alternatingly arranged with the fins, the meplat being substantially orthogonal to the body axis, and each flute comprising a concave outer surface and extending rearward of the leading axis point; and a plurality of standoffs extending away from both the trailing axis point and the leading axis point, wherein the plurality of standoffs defines a cavity.

2. The projectile of claim 1, wherein each of the plurality of standoffs extends from the leading axis point to the meplat.

3. The projectile of claim 2, wherein the meplat comprises a plurality of discrete surfaces separated by the plurality of standoffs.

4. The projectile of claim 3, wherein the plurality of discrete surfaces prevents the leading axis point from touching a primer of an adjacent projectile.

5. The projectile of claim 1, wherein each of the plurality of fins comprises a sloping surface extending from a side surface of the body to the meplat.

6. The projectile of claim 1, wherein each of the plurality of standoffs extends from the meplat.

7. The projectile of claim 1, wherein the plurality of standoffs prevents the leading axis point from touching a primer of an adjacent projectile.

8. The projectile of claim 1, wherein the leading axis point is defined on the meplat.

9. The projectile of claim 1, wherein the meplat is a continuous surface shaped by an intersection of the plurality of fins.

10. The projectile of claim 9, wherein each of the plurality of standoffs is an extension of a one of the plurality of fins.

11. A cartridge comprising the projectile of claim 1.

12. The projectile of claim 1, wherein the cavity extends from the leading axis point to the meplat.

* * * * *